US007137772B2

(12) United States Patent
Blateri

(10) Patent No.: US 7,137,772 B2
(45) Date of Patent: Nov. 21, 2006

(54) RETRACTABLE DRUM FAN

(75) Inventor: Frank Blateri, Coppell, TX (US)

(73) Assignee: Diani, LLC., Dallas, TX (US)

( * ) Notice: Subject to any disclaimer, the term of this patent is extended or adjusted under 35 U.S.C. 154(b) by 204 days.

(21) Appl. No.: 10/848,487

(22) Filed: May 18, 2004

(65) Prior Publication Data

US 2005/0260063 A1 Nov. 24, 2005

(51) Int. Cl.
*F04D 29/40* (2006.01)
*F01D 25/24* (2006.01)

(52) U.S. Cl. ..... 415/1; 415/126; 415/214.1; 415/220; 417/234; 417/423.14

(58) Field of Classification Search ..... 415/1, 415/126, 214.1; 416/220, 63, 142; 417/234, 417/423.14
See application file for complete search history.

(56) References Cited

U.S. PATENT DOCUMENTS 3,827,342 A * 8/1974 Hughes ..... 454/231
4,239,459 A * 12/1980 Felter ..... 417/234
4,347,782 A * 9/1982 Hoecke ..... 454/231
D323,708 S 2/1992 Wang
D395,080 S 6/1998 Jane et al.
D398,983 S 9/1998 Keller et al.
D405,520 S 2/1999 Birdsell
D421,114 S 2/2000 Lozzio et al.
D422,073 S 3/2000 Lozzio et al.
D424,683 S 5/2000 Bellil et al.
D427,674 S 7/2000 Moreno
6,098,312 A * 8/2000 Tuggle ..... 34/607
D433,497 S 11/2000 Hotaling et al.
D440,648 S 4/2001 Lee et al.
D444,871 S 7/2001 Wilson, Jr.
D456,066 S 4/2002 Ching
D459,454 S 6/2002 Shapiro
D466,599 S 12/2002 Bragg et al.

* cited by examiner

*Primary Examiner*—Edward K. Look
*Assistant Examiner*—Devin Hanan
(74) *Attorney, Agent, or Firm*—Haynes and Boone LLP

(57) ABSTRACT

A retractable drum fan in which two housing sections are telescoped to form a housing, and an impeller is disposed in the housing for forcing air through the housing. The housing sections are movable between a retracted position and an extended position.

19 Claims, 3 Drawing Sheets

RETRACTABLE DRUM FAN

BACKGROUND

This invention relates to a drum fan for moving relative large quantities of air in domestic and commercial applications.

Drum fans are well known and include a blade, or impeller, that rotates in a cylindrical housing having an air inlet at one end and an outlet at the other. These designs lend themselves to movement of relative large quantities of air such as in commercial applications.

Drum fans of this type are very popular, and therefore are very cost competitive. However, due to their large size, shipping costs add a considerable amount to the total costs of the drum fan to the manufacturer and distributor, and therefore to the customer.

Therefore what is needed is a drum fan that can be shipped at a relative low cost.

DETAILED DESCRIPTION

Figure 1:
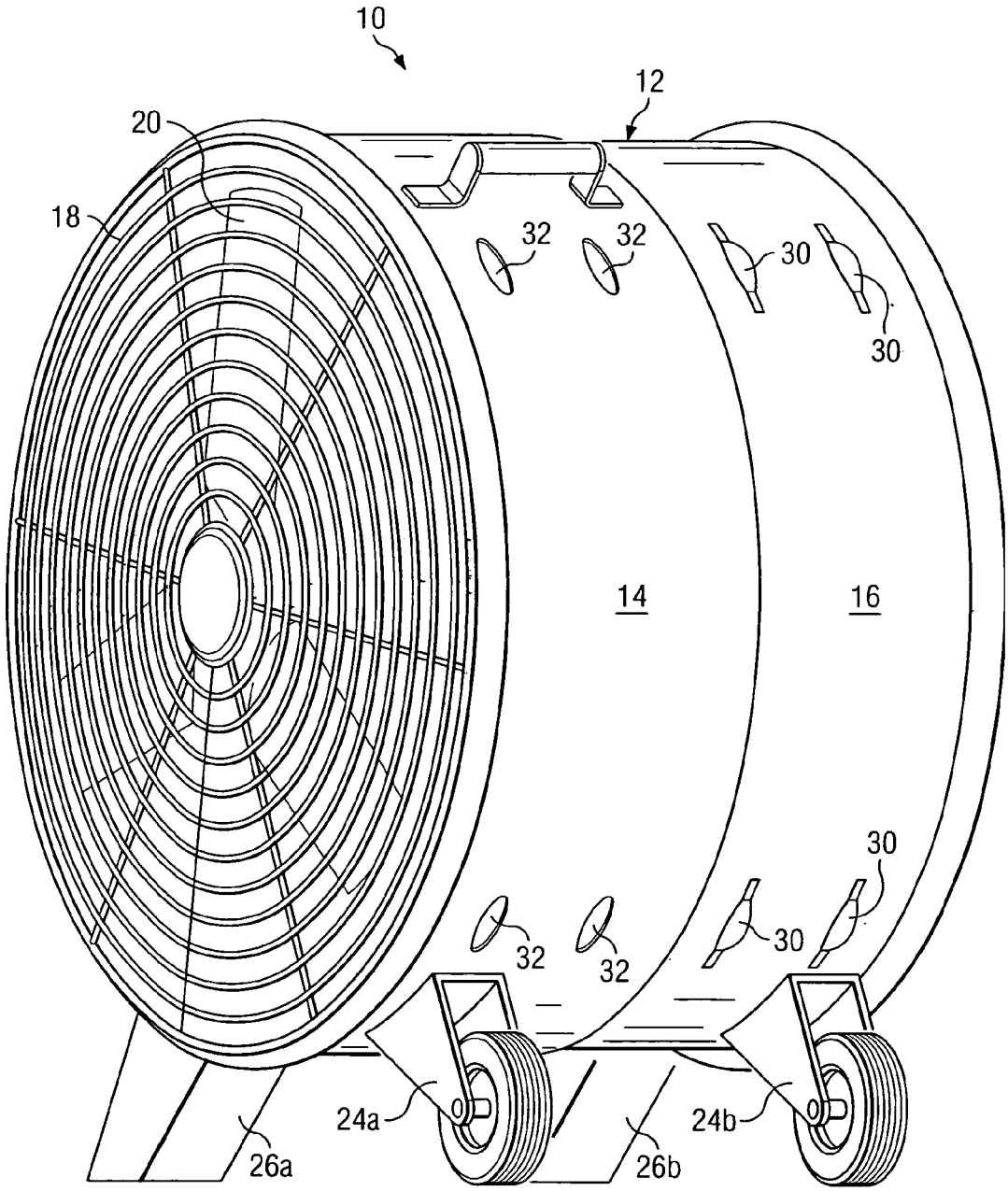
FIG. 1 is an isometric view of a drum fan according to an embodiment of the invention.

Referring to FIG. 1, the reference numeral 10 refers, in general, to a retractable drum according to an embodiment of the invention. The drum 10 includes a cylindrical housing 12 formed by two telescoping sections 14 and 16. The sections 14 and 16 are shown in their maximum extended position in FIG. 1 but can be moved to a retracted position, as will be shown and described.

Both ends of the housing 12 are open and a conventional grill, or register, 18 is affixed to one open end of the housing 12 to define an air outlet. The other open end of the housing 12 defines an air inlet.

An impeller 20 is mounted in the housing, and is driven by a motor (not shown) to rotate the impeller and thus draw air into the above inlet and discharge it through the grill 18 and the outlet.

A pair of spaced roller assemblies 24*a* and 24*b* are mounted on a lower surface of the sections 14 and 16, respectively, of the housing 12 and extend opposite a pair of spaced support legs 26*a* and 26*b*, also mounted on the sections 14 and 16, respectively. The roller assemblies 24*a* and 24*b* and the legs 26*a* and 26*b* support the housing 12 in a slightly elevated position when the drum fan 10 is in use, and the roller assemblies permit the fan to be easily moved between locations.

Two pairs of angularly spaced raised bosses, or clips, 30 are provided on the outer surface of the housing section 16, with the bosses of each pair being axially spaced. Two pairs of angularly spaced apertures 32 extend through the wall of the housing section 16, with the apertures of each pair being axially spaced. The spacing of the apertures 32 is the same as the spacing of the bosses so that when the housing section 16 is retracted inwardly relative to the section 14, the bosses 30 extend in the apertures 32 to lock the sections in the retracted position, as will be discussed in more detail. Although only two pairs of bosses 30 and apertures 32 are shown in FIG. 1, it is understood that additional pairs can be provided; and, preferably, four pairs of the bosses and apertures are angularly spaced around the circumference of the sections 14 and 16 at ninety degree intervals.

Figure 2:
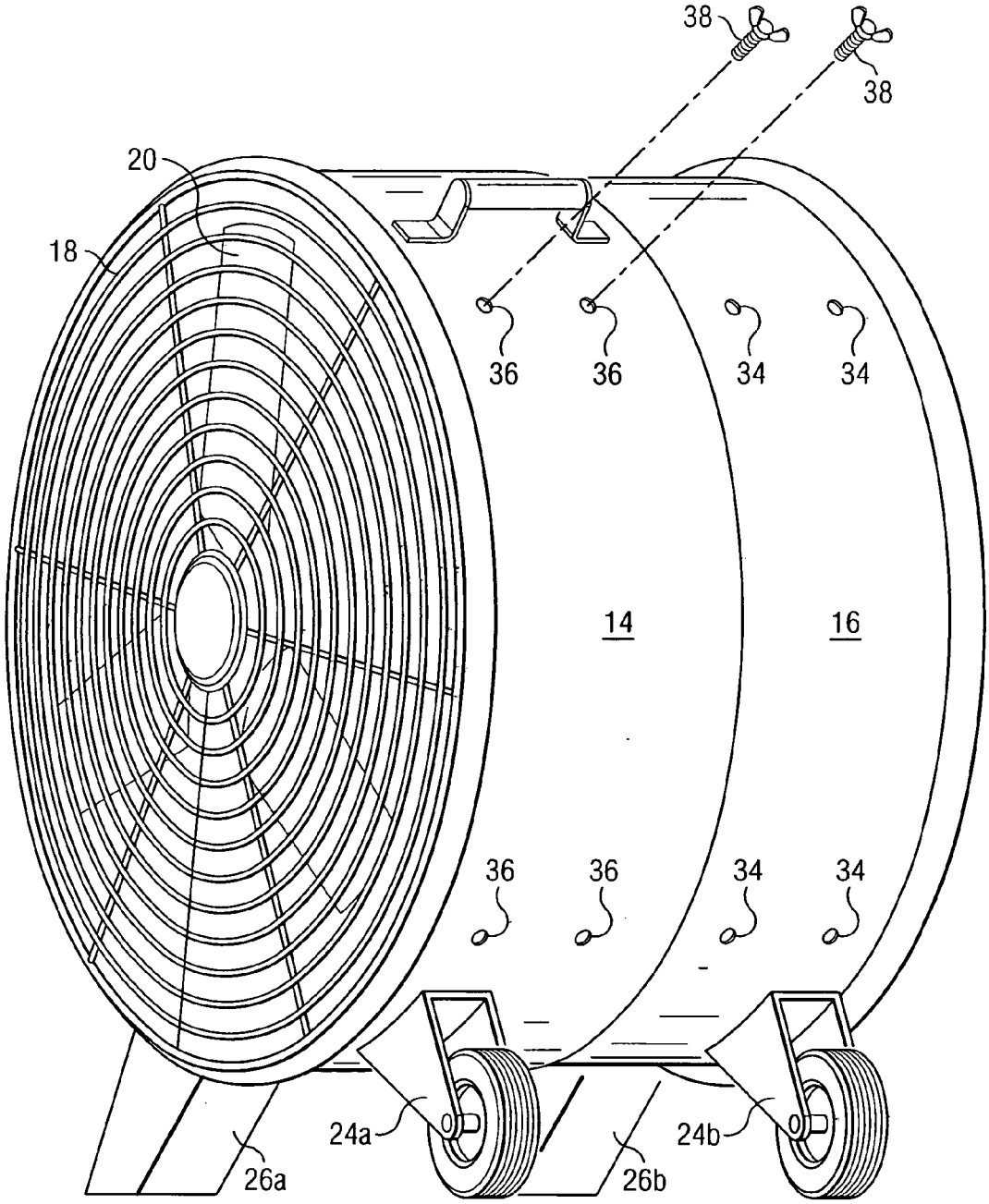
FIG. 2 is a view similar to that of FIG. 1 but depicting an alternate embodiment.

FIG. 2 depicts another mechanism for locking the housing sections in a retracted position. In particular, two pairs of angularly spaced apertures 34 extend through the wall of the housing section 14, with the apertures of each pair being axially spaced. Also, two pairs of angularly spaced apertures 36 extend through the wall of the housing section 16, with the apertures of each pair being axially spaced. The spacing of the apertures 34 is the same as the spacing of the apertures 36 so that when the housing section 16 is retracted inwardly relative to the section 14, each aperture 34 aligns with a corresponding aperture 36. Although only two pairs of apertures 34 and 36 are shown in FIG. 2, it is understood that additional pairs can be provided; and, preferably, four pairs of the apertures 34 and four pairs of the apertures 36 are angularly spaced around the circumference of the sections 14 and 16 at ninety degree intervals The apertures 34 and/or the apertures 36 are threaded and when aligned in the retracted position discussed above, an externally threaded wing nut 38 can be threadedly engaged in the aligned openings to lock the housing sections 14 and 16 in their retracted position. Although only two wing nuts 38 are shown in FIG. 2, it is understood that a wing nut can be provided for each set of aligned apertures 34 and 36.

Figure 3:
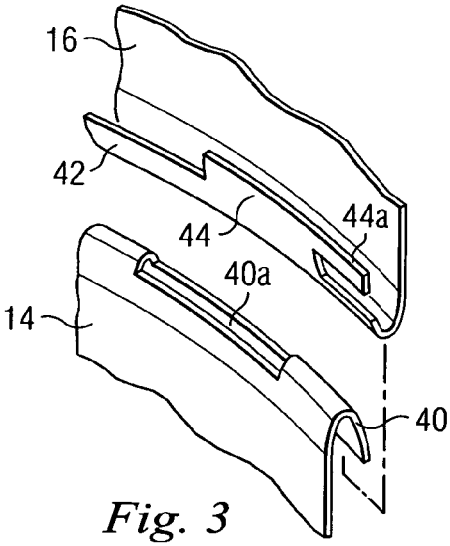
FIG. 3 is an enlarged partial isometric view of two sections of the drum of FIG. 1 depicting another alternate embodiment.

FIG. 3 depicts a mechanism for locking the housing sections 14 and 16 in the extended position of FIGS. 1 and 2. In particular, the corresponding telescoping end portions of the sections 14 and 16 are bent back to form tabs 40 and 42, respectively. An elongated slot 40*a* is formed in the end of the housing section 14 formed by the bent-back tab 40; and a flange 44, having an extension 44*a*, is formed on the end of the tab 36. The dimensions of the slot 40*a* and the flange 44 are such that the flange can be positioned in the space between the tab 40 and the housing section 14 and inserted through the slot 40*a*, when the fan is in its extended position of FIG. 1. The housing section 16 can then be rotated slightly relative to the housing section 14, or vice versa, so that the flange extension 44*a* moves out of the slot and over a portion of the housing section 14 adjacent the slot to lock against relative axial movement between the housing sections, in the extended position of the housing 12 shown in FIGS. 1 and 2.

Figure 4A:
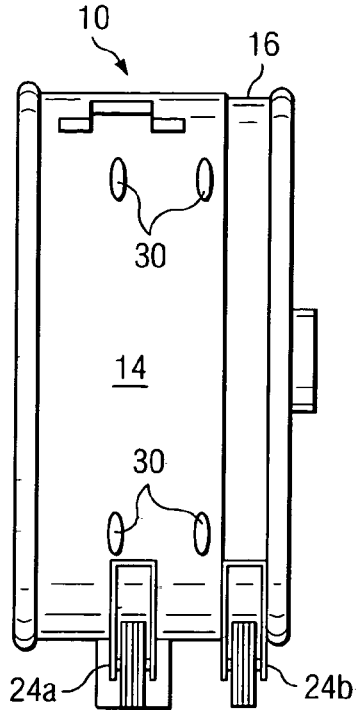
FIGS. 4A, 4B, and 4C are reduced side elevational views depicting the drum of FIG. 1 in three different configurations.
Figure 4B:
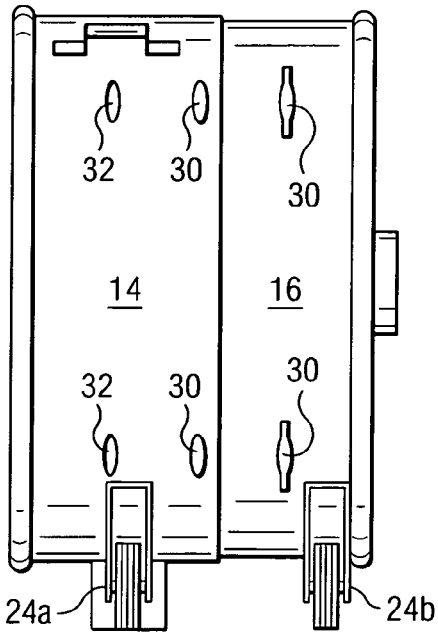
Figure 4C:
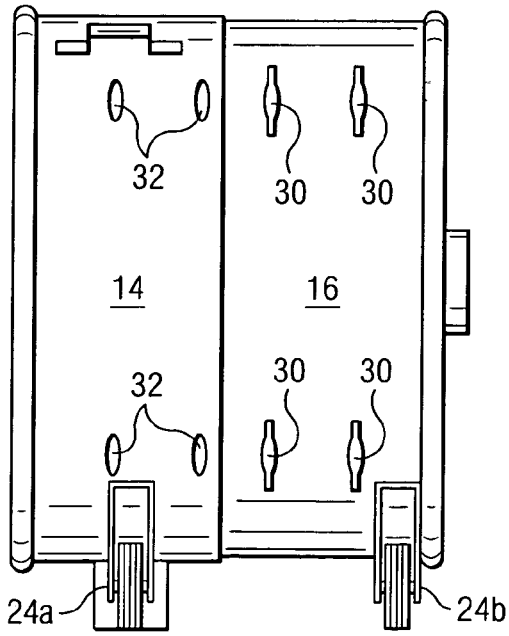

The housing 12 can be adjusted between the three configurations shown in FIGS. 4A, 4B, and 4C by moving one or both of the housing sections 14 and 16 in an axial direction relative to the other section to vary the length of the housing.

In particular, FIG. 4A depicts the housing section 16 in a fully retracted, telescoped, portion relative to the section 14. In this position the bosses 30 are engaged in the apertures 32 as described above, or the wing nuts 38 are threadedly engaged in the aligned apertures 34 and 36, to secure the housing section 16 relative to the section 14. This, of course, considerably reduces the size of the fan 10 which considerably reduces the shipping costs of the fan when compared to the costs associated with a fan sized similarly to the size of the fan 10 in its extended position of FIG. 1.

FIG. 4B depicts an intermediate, telescoped position of the housing section 16 relative to the housing section 14, and FIG. 4C depicts the fully expanded position which is also shown in FIG. 1 and which is the normal position of the sections when the fan 10 is in use. In the expanded position of FIG. 4C, the flange 44 is positioned in the space between the tab 40 and the housing section 14 and inserted through the slot 40*a*, after which the housing section 16 is rotated slightly relative to the housing section 14, or vice versa. As a result, the flange extension 44*a* moves out of the slot 40*a* and over a portion of the housing section 14 adjacent the slot to lock against relative axial movement between the housing sections 14 and 16, as described above.

The above arrangement permits the fan 10 to be moved to its retracted position shown in FIG. 4A for shipping, storage, or the like, and then moved to the expanded position of FIGS. 1, 2, and 4C when in use. Also, in the event the fan 10 must be used in a confined space, it can be adjusted to the positions of FIG. 4A or 4B.

Variations may be made in the foregoing without departing from the scope of the invention. For example, the number and location of the bosses 30, the apertures 32, 34 and 36, and the flange 44 can be varied within the scope of the invention. Also, the wing nuts 38 can be replaced by a threaded bolt, or the like. Further, the impeller 20 (and its motor) can be provided in either of the housing sections 14 or 16. Still further, the housing sections 14 and 16 can take positions relative to each other that are different from those described above, resulting in different lengths of the housing 12. Moreover, locking mechanisms, other than the exemplary ones described above, can be used to lock the housing sections 14 and 16 in their various relative positions.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A drum fan comprising two sections disposed in a telescoping relation and movable in an axial direction relative to each other, an impeller disposed in one of the sections for forcing air through the sections, and at least one boss formed on one section and adapted to extend in an aperture formed through the other section to lock the sections in a predetermined telescoped position.

2. The fan of claim 1 wherein the predetermined position is an extended position.

3. The fan of claim 1 wherein the predetermined position is a retracted position.

4. The fan of claim 1 wherein there are at least one pair of axially spaced bosses that extend in a corresponding pair of axially spaced apertures.

5. The fan of claim 4 wherein the sections are cylindrical and wherein there are a plurality of pairs of axially spaced bosses angularly spaced around the one section.

6. The fan of claim 1 wherein the boss and the aperture lock the sections in a retracted position.

7. The fan of claim 1 wherein the sections are cylindrical.

8. The fan of claim 1 wherein the sections form a housing, the length of which vanes when the sections are moved in an axial direction relative to each other.

9. A drum fan comprising two sections disposed in a telescoping relation and movable in an axial direction relative to each other, an impeller disposed in one of the sections for forcing air through the sections, a flange formed on one of the sections and a slot formed through the other sections for receiving the flange to lock the sections in a predetermined telescoped position.

10. The fan of claim 9 wherein the flange has an extension, so that, upon relative rotation between the sections, the extension moves out of the slot and over a portion of the one section adjacent the slot.

11. The fan of claim 10 wherein the flange and the slot are adapted to lock the sections in an extended position.

12. A drum fan comprising two sections disposed in a telescoping relation and movable in an axial direction relative to each other, an impeller disposed in one of the sections for forcing air through the sections, at least one boss formed on one section and adapted to extend in an aperture formed through the other section to lock the sections in a retracted position, and a locking mechanism for locking the sections in an extended position.

13. The fan of claim 12 wherein there are at least one pair of axially spaced bosses that extend in a corresponding pair of axially spaced apertures.

14. The fan of claim 13 wherein the sections are cylindrical and wherein there are a plurality of pairs of axially spaced bosses angularly spaced around the one section.

15. A drum fan comprising two sections disposed in a telescoping relation and movable in an axial direction relative to each other, an impeller disposed in one of the sections for forcing air through the sections, a wing nut adapted to threadedly engage aligned apertures in the sections when the sections are in a retracted position to lock the sections in the retracted position, and a locking mechanism for locking the sections in an extended position.

16. The fan of claim 15 wherein there are at least one pair of axially spaced apertures on each section that align with corresponding apertures on the other section.

17. The fan of claim 16 wherein the sections are cylindrical and wherein there are a plurality of pairs of axially spaced apertures angularly spaced around the one section.

18. A drum fan comprising two sections disposed in a telescoping relation and movable in an axial direction relative to each other, an impeller disposed in one of the sections for forcing air through the sections, a first locking mechanism for locking the sections in a retracted position, a flange formed on one of the sections, and a slot formed through the other sections for receiving the flange to lock the sections in an extended position.

19. The fan of claim 18 wherein the flange has an extension, so that, upon relative rotation between the sections, the extension moves out of the slot and over a portion of the one section adjacent the slot.

* * * * *